US005190467A

United States Patent [19]

Ohta

[11] Patent Number: 5,190,467

[45] Date of Patent: Mar. 2, 1993

[54] CONNECTOR

[75] Inventor: Yukio Ohta, Shizuoka, Japan

[73] Assignee: Yazaki Corporation, Tokyo, Japan

[21] Appl. No.: 788,016

[22] Filed: Nov. 5, 1991

[30] Foreign Application Priority Data

Nov. 27, 1990 [JP] Japan ..... 2-123598[U]

[51] Int. Cl.[5] ..... H01R 13/627

[52] U.S. Cl. ..... 439/354; 439/357

[58] Field of Search ..... 439/345, 350, 351, 352, 439/353, 354, 357, 358

[56] References Cited

U.S. PATENT DOCUMENTS 4,979,910 12/1990 Revil et al. ..... 439/357 X
4,986,766 1/1991 Leonard et al. ..... 439/357 X
5,015,199 5/1991 Hirano et al. ..... 439/357 X

FOREIGN PATENT DOCUMENTS 63-28546 8/1988 Japan .
1-43987 9/1989 Japan .

*Primary Examiner*—Larry I. Schwartz

*Assistant Examiner*—Khiem Nguyen

*Attorney, Agent, or Firm*—Nikaido, Marmelstein, Murray & Oram

[57] ABSTRACT

One of the mating connector housings has a locking arm and the other connector housing has an engagement sleeve that receives the locking arm. The locking arm rises through a base at the front outer circumference of the first housing and extends axially rearwardly. The locking arm has guide means formed at the base. The engagement sleeve has engagement groove means formed in side walls thereof that extend axially from the front opening toward the rear and which receives the guide means. When the paired connector housings are connected together, the guide means of the locking arm are received into the engagement groove means in the engagement sleeve to prevent the weak portion of the connector housing formed with the locking arm from being deformed, thus providing a good locking feel and also an adequate engagement stroke. This makes the complete connection of the connector housings easily verifiable.

2 Claims, 2 Drawing Sheets

CONNECTOR

BACKGROUND OF THE INVENTION

1. Field of the Invention

The present invention relates to a connector which consists of a pair of opposing male and female housings each containing terminal lugs and which is capable of verifying the complete connection of these housings.

2. Description of the Prior Art

As shown in FIG. 3, a female housing a has a circumferential wall $a_1$ and a locking arm b, which rises through a base $b_1$ from the front part of the circumferential wall and extends rearwardly. A male housing c has an engagement chamber d for the locking arm b.

The interior of the circumferential wall $a_1$ of the female housing constitutes an insertion space to receive a terminal accommodating block $c_1$ of the male housing c.

In such male and female connector housings, the circumferential wall $a_1$ at the front of the female housing is weak, so that during the process of connection and locking, the load bearing on the locking arm b is applied through the base $b_1$ to the circumferential wall $a_1$, deforming the wall $a_1$ around the base $b_1$. As a result, the resilient force of the locking arm b cannot be fully applied to an engagement portion e. Not only does this fail to produce an appropriate engagement stroke but also cannot provide a good locking feel when the locking arm b returns to its original shape at the completion of the locking process. The connector housings of the above construction therefor are apt to result in an incomplete connection.

SUMMARY OF THE INVENTION

The invention is intended to prevent the deformation of the weak portion when the paired connector housings are being locked together, to provide an appropriate engagement stroke and also provide a good locking feel of the locking arm returning to its original shape when the locking process is completed.

To achieve the above objective, a connector according to this invention comprises: a pair of mating connector housings; a locking arm provided to the first connector housing, said locking arm rising through a base from the front outer circumference of said first housing and extending axially rearwardly; guide means provided to said base of the locking arm; an engagement sleeve provided to the second connector housing to receive the locking arm; and engagement groove means formed in side walls of said engagement sleeve in such a way that they extend from a front opening of the engagement sleeve toward the rear in the axial direction, said engagement groove means being adapted to receive the guide means of the base of the locking arm.

The engagement—which begins as the first and housings start to be coupled—between the guide means provided to the base of the locking arm and the engagement groove means formed in the walls of the engagement sleeve prevents the housing provided with the locking arm from being deformed and also provides a specified engagement stroke and a good locking feel, making it possible to confirm the secure connection of the housings with an accompanying clicking sound.

DETAILED DESCRIPTION OF PREFERRED EMBODIMENT

Figure 1:
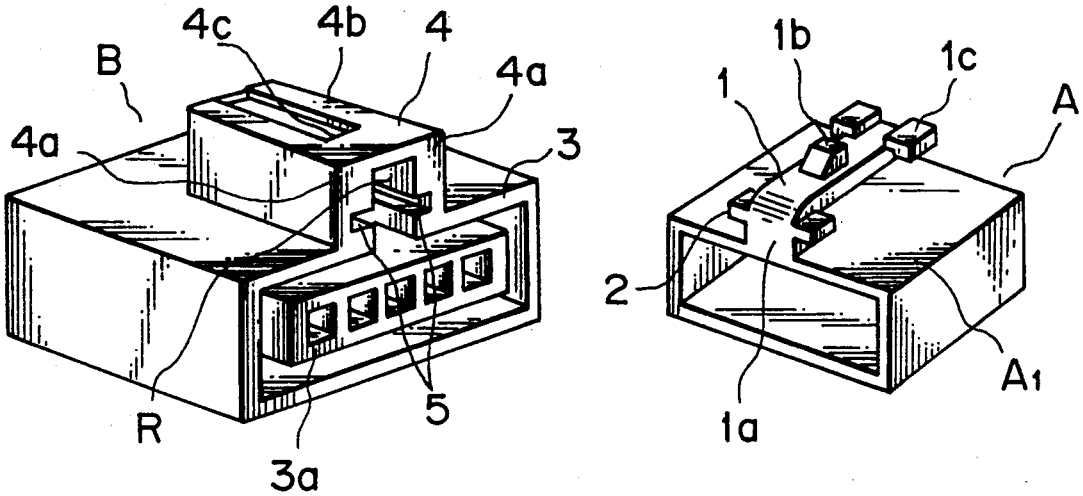
FIG. 1 is a perspective view of a pair of mating connector housings of this invention shown disassembled.
Figure 2:
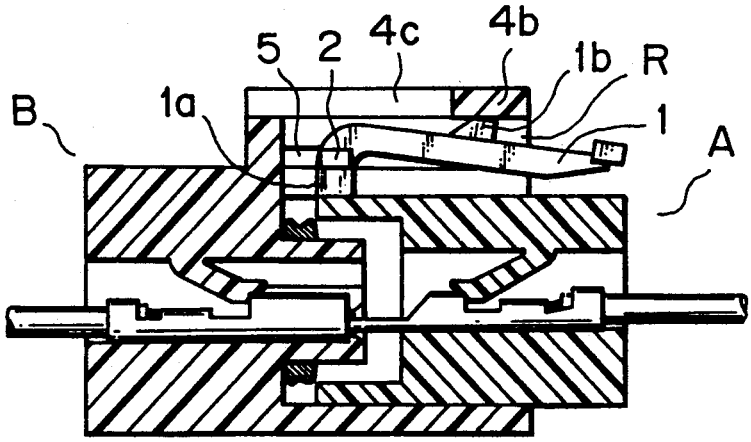
FIG. 2 is a cross section of the connector housings of FIG. 1 during the process of connection.
Figure 3:
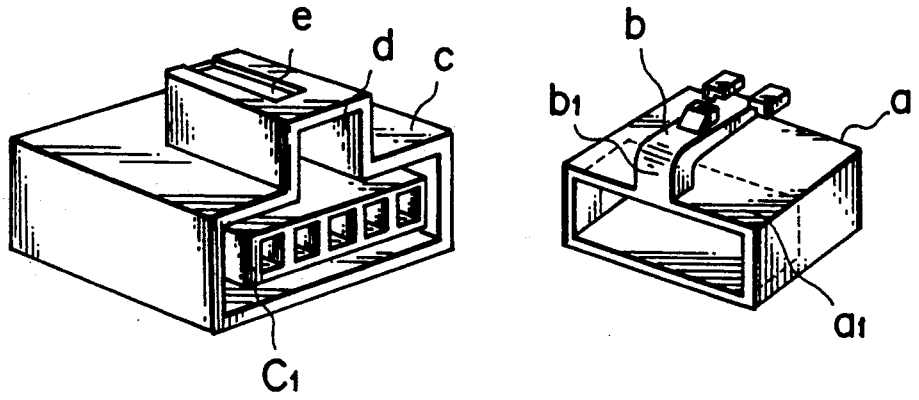
FIG. 3 PRIOR ART
FIG. 3 is a perspective view of a pair of mating connector housings of a conventional connector in a disassembled condition.
Figure 4:
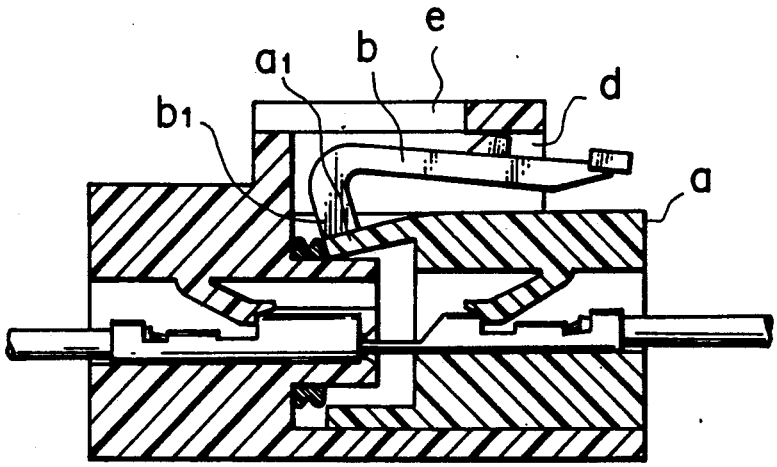
FIG. 4 PRIOR ART
FIG. 4 is a cross section of the connector housings of FIG. 3 during the process of connection.

Referring to FIG. 1, reference symbol A represents a female waterproof connector housing and B a male waterproof connector housing, both made of synthetic resin. Each of the connector housings securely accommodates terminal lugs therein.

A case portion $A_1$ of the female connector housing A has a space therein and also a base $1_a$ formed at the front upper portion thereof, from which a locking arm 1 extends rearwardly. The locking arm I has a lock projection 1*b* at an intermediate portion and an operation portion 1*c* at the end. The base 1*a* has a pair of guide wings 2 on each side.

The male connector housing B has an enclosure portion 3 on the outside and a terminal accommodating block 3*a* formed therein. The enclosure portion 3 has an engagement sleeve 4 projected from the upper part thereof in which an engagement chamber R is formed.

The engagement sleeve 4 has a pair of grooves 5 extending axially in side walls 4*a* from the front opening toward the rear. It also has an engagement opening 4*c* formed in an upper wall 4*b*.

In the above construction, as the female and male waterproof connector housings are connected together, the base 1*a* of the locking arm 1 advances into the engagement chamber R and at the same time the guide wings 2 are received into the grooves 5 until the engagement projection 1*b* fits into the engagement opening 4*c*.

Since the guide wings 2 engage with the grooves 5 the moment the housings start to be connected, the load bearing on the base 1*a* of the locking arm I is received by the grooves 5, thus preventing the case portion $A_1$ from being deformed.

The construction and advantage of this invention may be summarized as follows. A locking arm is provided to one of the mating connector housings and an engagement sleeve that receives the locking arm is provided to the other housing. The locking arm rises through a base at the front outer circumference of the housing and extends axially rearwardly. The locking arm has guide means formed at the base. The engagement sleeve has engagement groove means formed in side walls thereof that extend axially from the front opening toward the rear and which receives the guide means. When the paired connector housings are connected together, this construction prevents the weak portion of the connector housing formed with the locking arm from being deformed. This provides a good locking feel and also ensures an adequate engagement stroke, thus making the complete connection of the connector housings easily verifiable.

What is claimed is:

1. A connector comprising:

a male connector housing;

a female connector housing;

a locking arm formed on an outside portion of said female connector housing, said locking arm having a base formed integrally with said female connector housing at a forward portion thereof, said locking arm extending axially rearwardly from the base;

guide means provided at the base of said locking arm and extending laterally relative to said locking arm, for guiding insertion of said locking arm into an engagement sleeve;

an engagement sleeve housing integrally formed on an outside portion of said male connector housing, said engagement sleeve housing including an engagement sleeve therein formed so as to receive said locking arm; and engagement groove means extending along a length of the engagement sleeve for, receiving said guide means thereinto.

2. A connector according to claim 1, wherein said guide means includes a pair of guide wings opposingly positioned along said locking arm, and said engagement groove means includes a pair of grooves opposingly positioned along opposing inner walls of the engagement sleeve and extending along a length of the engagement sleeve.

* * * * *